United States Patent [19]

Gann

[11] Patent Number: 4,565,520

[45] Date of Patent: Jan. 21, 1986

[54] RECYCLING PILOT IGNITION SYSTEM

[75] Inventor: Ronald A. Gann, La Crescenta, Calif.

[73] Assignee: ITT Corporation, New York, N.Y.

[21] Appl. No.: 575,097

[22] Filed: Jan. 30, 1984

[51] Int. Cl.[4] ..... F23Q 9/08

[52] U.S. Cl. ..... 431/46; 431/69

[58] Field of Search ..... 431/46, 69, 51, 54, 431/55

[56] References Cited

U.S. PATENT DOCUMENTS

| | | | |
|---|---|---|---|
| 3,872,320 | 3/1975 | Juskewicz, Jr. | 431/69 |
| 4,019,854 | 4/1977 | Carlson et al. | 431/78 |
| 4,124,354 | 11/1978 | Gann | 431/46 |
| 4,128,387 | 12/1978 | Rayburn et al. | 431/69 |
| 4,137,035 | 1/1979 | Cade | 431/46 |
| 4,145,180 | 3/1979 | Bendorf | 431/46 |
| 4,231,732 | 11/1980 | Newport, Jr. et al. | 431/46 |

*Primary Examiner*—Samuel Scott
*Assistant Examiner*—Noah Kamen
*Attorney, Agent, or Firm*—T. L. Peterson; J. S. Christopher

[57] ABSTRACT

An improved system including a circuit for igniting a pilot burner each time heat is called for by a thermostat. The main burner is ignited by the standing pilot upon detection of pilot ignition. Trial ignition over a limited period of time is provided. Main and pilot oscillators each having only two transistors are employed to actuate respective main and pilot valves. Each oscillator is of a new type requiring few electronic components.

2 Claims, 2 Drawing Figures

RECYCLING PILOT IGNITION SYSTEM

BACKGROUND OF THE INVENTION

This invention relates to gas fired devices, and more particularly to improved controls for main and pilot valves including improved oscillators therefor.

PRIOR ART STATEMENT

It is known to use an oscillator to supply an ignitor and a valve for trial ignition. For example, see E. A. Carlson et al. U.S. Pat. No. 4,019,854 issued Apr. 26, 1977 and R. A. Gann U.S. Pat. No. 4,124,354.

In Carlson see column 3, line 9, " . . . the oscillator includes . . . " See also "spark ignitor" 11 in FIG. 1, "trial ignition" in the Abstract, and "Valve 12 . . . having a solenoid winding . . . 13" in column 1, lines 41–42.

In Gann, a pilot oscillator 72 in FIG. 5 includes a Darlington circuit of two transistors 88 and 89 (a Darlington pair). A spark ignitor 11 is shown in FIG. 4 powered from oscillator 72 in FIG. 5. The phrase "trial ignition" is found again in the Abstract.

In FIG. 6, Gann also discloses a main valve oscillator 104 with another Darlington pair 125 and 126.

SUMMARY OF THE INVENTION

In accordance with one aspect of the present invention, the above-described and other disadvantages of the prior art are overcome by providing a spark ignitor with a pilot oscillator for pilot valve control wherein the spark ignitor is supplied with electrical power separate from the oscillator.

According to another aspect of the present invention, there is provided a Darlington pair which acts both as a gate and as a feedback amplifier for a pilot and/or main or other oscillator.

BRIEF DESCRIPTION OF THE DRAWINGS

In the accompanying drawings which illustrate exemplary embodiments of the present invention.

DESCRIPTION OF THE PREFERRED EMBODIMENT

Figure 1:
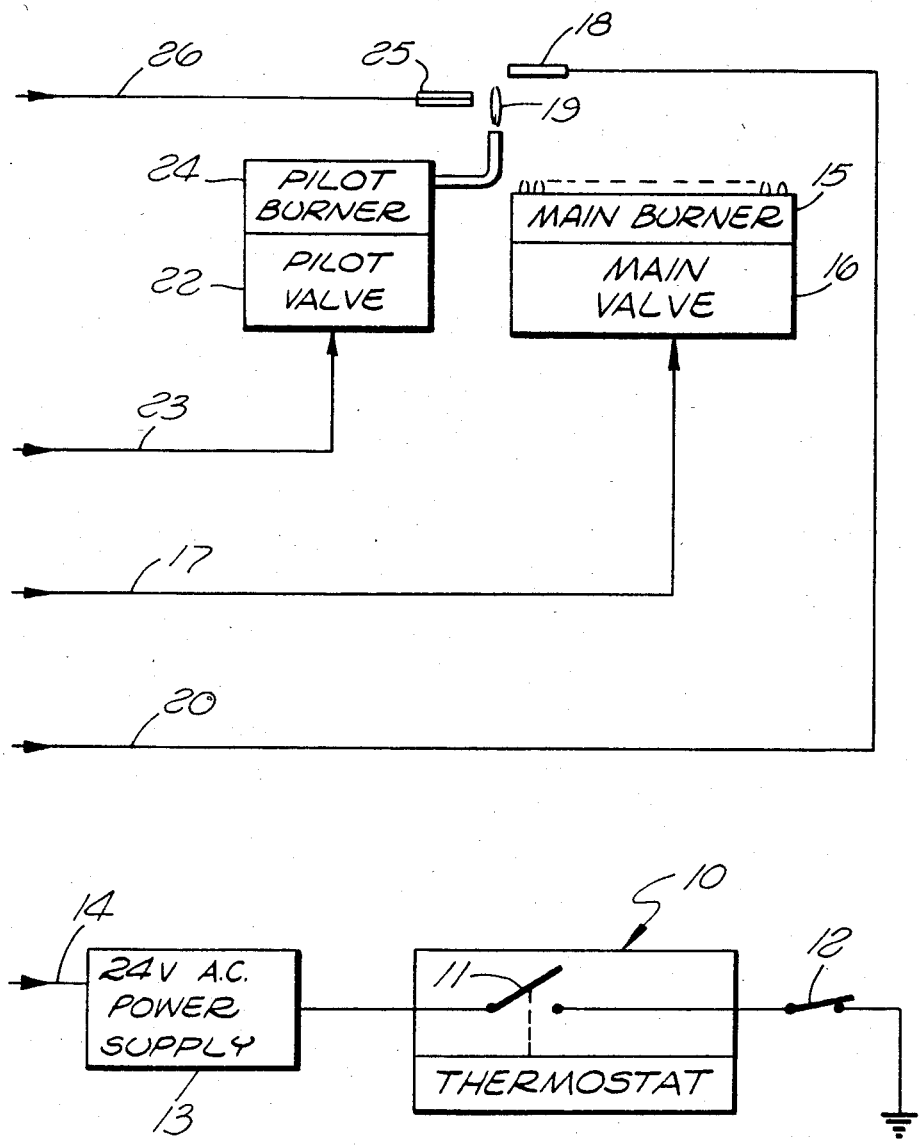
FIG. 1 is a block diagram of a portion of one embodiment of the present invention.

In FIG. 1, a thermostat is provided at 10 including a thermostatic switch 11 which is connected in series with a manual switch 12. Switches 11 and 12 are connected in series from a power supply 13 to ground. Switch 12 is employed such that in some cases, if there is a complete failure at trial ignition, the circuit having been automatically turned off, the trial ignition can then be started up again by opening and then closing switch 12. Power supply 13 is connected from a lead 14 in FIG. 2.

The device of the present invention is a gas fired device. That is, the same normally employs natural gas. The same is ignited at the top of a main burner 15 shown in FIG. 1. Gas is admitted to main burner 15 via a main valve 16. Main valve 16 is a solenoid valve controlled electrically over a lead 17 which can also be seen in FIG. 2.

Again in FIG. 1, a flame rod 18 is shown to detect the ignition of a pilot flame 19. Flame rod 18 is connected via an electrical connection 20 from a lead 20 in FIG. 2 connected from a junction 21. Lead 20 is shown in both FIGS. 1 and 2. Junction 21 is shown only in FIG. 2.

Figure 2:
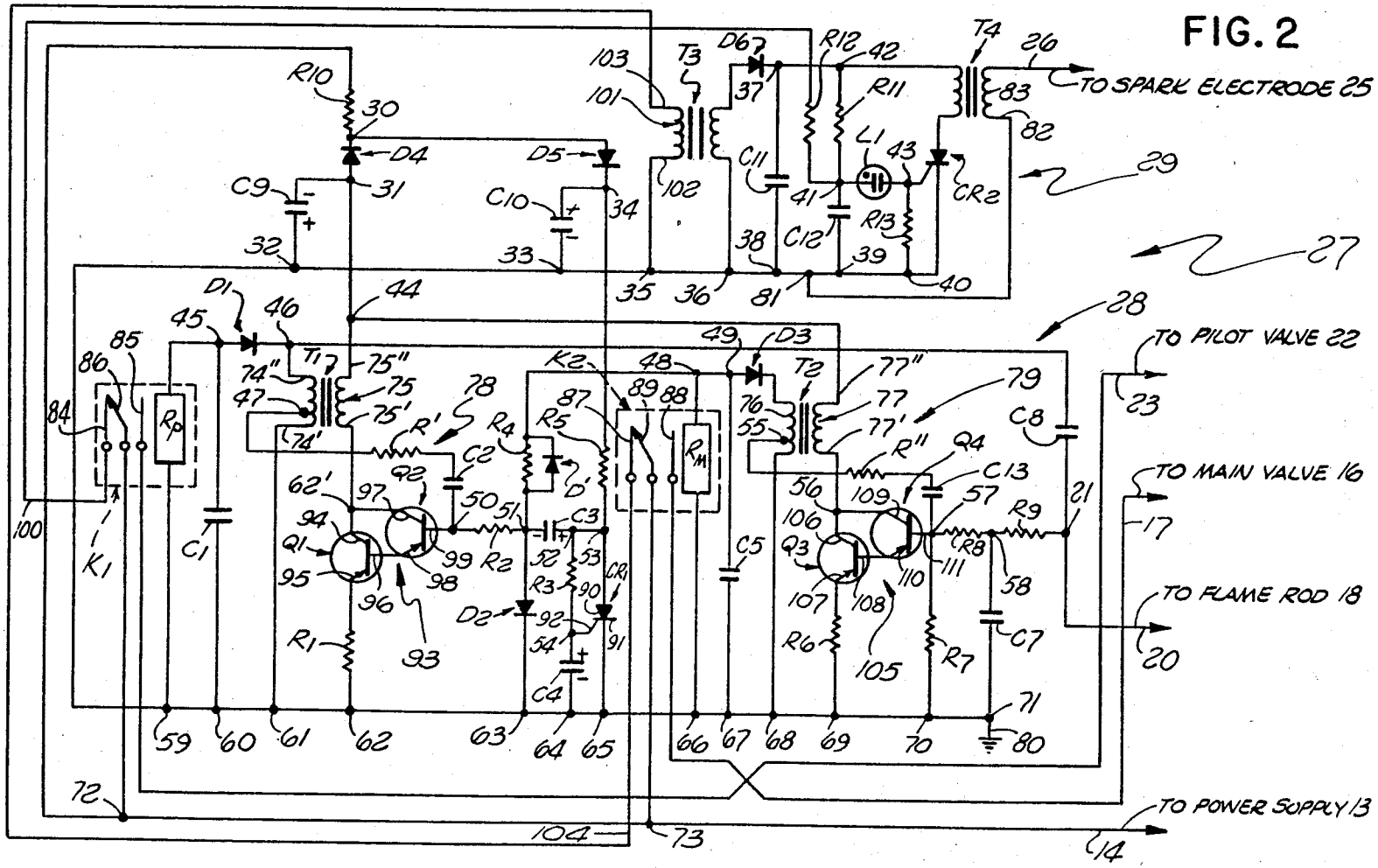
FIG. 2 is a schematic diagram of the remainder of the embodiment.

A pilot valve 22 is provided having an electrical control lead 23 shown in both FIGS. 1 and 2.

Pilot valve 22 operates or admits gas to a pilot burner 24. Gas from a pilot burner 24 is ignited at 19 by a spark which is emitted from an electrode 25 connected from a lead 26 shown in both FIGS. 1 and 2.

Everything disclosed under the last heading herein may be entirely conventional. The circuit of FIG. 2 is not conventional but is constructed in accordance with the present invention.

The circuit of FIG. 2 is approximately divided into two parts. The first part is a higher tier 27. The second part is a lower tier 28.

One portion of the upper tier 27 includes an ignitor circuit 29.

In upper tier 27, junctions 30, 31, 32, 33, 34, 35, 36, 37, 38, 39, 40, 41, 42 and 43 are provided.

In FIG. 2, transformers $T_1$ and $T_2$ are provided. Transformer $T_1$ is provided with a primary winding 75 and a secondary winding 74. Secondary winding 74 has a fixed tap 47.

Transformer $T_2$ is provided with a primary winding 77 and a secondary winding 76. Secondary winding 76 has a fixed tap 55.

Lower ties 28 then has junctions 45, 46, 48, 49, 50, 51, 52, 53, 54, 56, 57, 58, 59, 60, 61, 62, 63, 64, 65, 66, 67, 68, 69, 70, 71, 72 and 73.

Relays $K_1$ and $K_2$ are also provided. The circuitry immediately adjacent to relay $K_1$ includes a pilot oscillator 78.

The circuitry closely adjacent to relay $K_2$ includes a main oscillator 79.

What is meant by "pilot" and "main" is that the same causes relays $K_1$ and $K_2$, respectively, to open pilot valve 22 and main valve 16, respectively.

A diode $D_4$ is provided connected between junctions 30 and 31 and poled to be conductive in a direction toward junction 30 to provide rectified voltage for the transformer primaries 75 and 77.

Note will be taken that a lead 80 connects junction 71 to ground. Similarly, a large number of junctions are connected to ground. These junctions are 32, 33, 35, 36, 38, 39, 40, 59, 60, 61, 62, 63, 64, 65, 66, 67, 68, 69, 70 and 71. A junction 81 is also provided so that one end 82 of a secondary winding 83 of a spark ignitor transformer $T_4$ may be grounded at the junction 81.

The rectified product of diode $D_4$ is smoothed by capacitor $C_9$. Capacitor $C_9$ is connected between junctions 31 and 32.

As will be noted, power supply 13 in FIG. 1 is connected via lead 14 to junctions 73 and 72, and to a resistor $R_{10}$ which then has a connection to junction 30.

A diode $D_5$ is connected from junction 30 to junction 34 and is poled to be conductive in a direction toward junction 34.

Relays $K_1$ and $K_2$ may have the same structure, if desired. The relays $K_1$ and $K_2$ are both conventional.

Relay $K_1$ includes two fixed contacts 84 and 85, and a movable contact 86. Relay $K_1$ has a solenoid winding $R_p$.

Relay $K_2$ has two fixed contacts 87 and 88, and a movable contact 89. Relay $K_2$ has a solenoid winding $R_m$.

A capacitor $C_{10}$ is connected between junctions 33 and 34. A resistor $R_5$ is connected between junctions 34 and 53. A diode D' is connected in parallel with resistor $R_4$ and poled to be conductive toward junction 48.

A silicon controlled rectifier $CR_1$ is provided having an anode 90 connected from junction 53, and a cathode 91 connected to junction 65. Silicon controlled rectifier $CR_1$ also has a gate 92 connected to junction 54. Junctions 52 and 53 are connected together. A resistor $R_3$ is connected between junctions 52 and 54. A capacitor $C_4$ is connected between junctions 54 and 64.

A capacitor $C_3$ is connected between junctions 51 and 52. A resistor $R_2$ is connected between junctions 50 and 51. A capacitor $C_2$ is connected from transformer tap 47 to junction 50 through a resistor R'.

A resistor $R_4$ is connected from junction 48 to junction 51.

A Darlington pair 93 of transistors $Q_1$ and $Q_2$ is also shown in FIG. 2. Transistors $Q_1$ and $Q_2$ act both as a gate and as a feedback amplifier for the pilot oscillator 78. This is new in accordance with the present invention.

Transistor $Q_1$ has a collector 94, an emitter 95, and a base 96. Transistor $Q_2$ has a collector 97, an emitter 98, and a base 99.

A resistor $R_1$ is connected from emitter 95 to junction 62. Collector 94 is connected to a junction 62'. Transformer primary 75 has a lower end 75' also connected to junction 62'. Collector 97 is also connected to junction 62'. The emitter 98 of transistor $Q_2$ is connected to the base 96 of transistor $Q_1$. The base 99 of transistor $Q_2$ is connected from junction 50.

Capacitor $C_2$ is the feedback capacitor.

Portions of the main oscillator 79 may be identical to portions of the pilot oscillator 78.

Transformer primary 75 which has an upper end 75" connected to junction 44. Similarly, transformer primary 77 has a lower end 77' and an upper end 77". End 77" is also connected to junction 44.

Transformer secondary winding 74 has a lower end 74' and an upper end 77". Upper end 77" is connected to junctin 46. Lower end 74' is connected to junction 61. A capacitor $C_1$ is connected between junctions 45 and 60.

The winding $R_p$ of relay $K_1$ is connected from junction 45 to junction 59. A diode $D_1$ is connected between junctions 45 and 46 and poled to be conductive in a direction toward junction 46.

Substantially all of the spark ignitor 29 may be conventional except the secondary winding 83 of transformer $T_4$. Lower end 82 of winding 83 is connected to junction 81. However, there is a difference in the connection of transformer $T_3$. There is at least one difference in that resistor $R_{12}$ is connected to junction 41 from contact 84 of relay $K_1$ via lead 100.

Still further, any conventional spark ignitor may be substituted for spark ignitor 29 provided the functions of the inputs and the outputs of transformer $T_3$ and resistor $R_{12}$, et al. are maintained.

In FIG. 2, note will be taken that transformer $T_3$ has a primary winding 101 that has a lower end 102 connected to junction 35 and an upper end 103 connected to fixed contact 87 of relay 88 via a lead 104.

Spark ignitor 29 has other components as follows: a diode $D_6$, a capacitor $C_{11}$, a resistor $R_{11}$, a capacitor $C_{12}$, a gas discharge tube $L_1$, a resistor $R_{13}$, a silicon controlled rectifier $CR_2$.

A resistor $R_9$ is connected between junctions 58 and 21. A resistor $R_8$ is connected between junctions 57 and 58. A capacitor $C_7$ is connected between junctions 58 and 71. A resistor $R_7$ is connected between junctions 57 and 70. A feedback capacitor $C_{13}$ is connected between fixed tap 55 on transformer winding 76 to junction 57 through resistor R".

A Darlington pair 105 of transistors $Q_3$ and $Q_4$ is provided in main oscillator 79. The lower end 77' of primary winding 77 of transformer $T_2$ is connected to junction 56. Transistor $Q_3$ has a collector 106, an emitter 107 and a base 108. Transistor $Q_4$ has a collector 109, an emitter 110 and a base 111. Collector 106 is connected to junction 56. A resistor $R_6$ is connected between emitter 107 and junction 69. The base 108 of transistor $Q_3$ is connected to the emitter 110 of transistor $Q_4$. The base 111 of transistor $Q_4$ is connected to junction 57. The collector 109 of transistor $Q_4$ is connected to junction 56.

In FIG. 2, leads 23 and 17 are connected from fixed contacts 85 and 88, respectively. Lead 14 is connected to junction 73, to junction 72 and to resistor $R_{10}$. Burners 15 and 24 are always at ground potential.

OPERATION (1) Power is first supplied via lead 14 when heat is called for and switches 11 and 12 are closed.

(2) Diode $D_5$ then charges capacitors $C_{10}$, $C_3$ and $C_4$.

(3) When the potential of junction 54 is high enough, silicon controlled rectifier (SCR) $CR_1$ fires.

(4) When SCR $CR_1$ fires, junction 50 is maintained negative and the Darlington pair 93 acts as a gate and acts as a feedback amplifier, and pilot oscillator 78 oscillates.

(5) Then relay winding $R_p$ is energized and contact 86 moves out of engagement with fixed contact 84 into engagement with fixed contact 85. This concurrently (a) interrupts the connection between power supply 13 and resistor R12 to remove an inhibiting potential from the spark ignitor 29, and (b) connects the power supply 13 to pilot valve 22 via lead 23 to open the pilot valve. Gas is thus emitted from pilot burner 24.

(6) It is important to note that the connection of resistor $R_{12}$ to junction 41 inhibits ignition when contact 86 engages contact 84 but when relay $K_1$ is energized, a spark will jump from electrode 25 (FIG. 1) to pilot burner 24. If there is no malfunction, the pilot then lights, see (5) (c) above.

(7) If the pilot lights, conventional flame rod 18 operates in the conventional way, junctions 21, 58 and 57 are maintained negative, and main oscillator 79 oscillates, energizes relay $K_2$, removes lead 104 to transformer winding end 103 from power supply 13 (turns off the spark), and opens the main valve 16. Main burner 15 is then supplied with gas which is ignited by the standing pilot.

(8) In case of pilot gas ignition failure:

(a) Trial ignition takes place as aforesaid, but upon failure of pilot ignition, capacitor $C_3$ will discharge, relay $K_1$ will be de-energized, contacts 84 and 86 will be closed, contacts 85 and 86 will be opened, pilot valve 22 will be closed, and ignitor 29 will be disabled.

(9) Failure of pilot ignition anytime will shut down main oscillator 79 via flame rod 18.

(10) Pilot oscillator 78 will fail to oscillator if main oscillator 79 does not oscillater and deliver adequate sustaining negative bias to junction 51 via the parallel combination of resistor $R_4$ and diode D'.

COMPARISON TO THE PRIOR ART

The reference hereinafter to the "prior device" shall mean the system of said U.S. Pat. No. 4,124,354. The reference hereinafter to the "new device" shall mean the system of the present invention.

In the prior device, the concept of a "gated oscillator" was employed. One oscillator was used to supply pilot valve power and another oscillator was used to supply main burner valve power.

The pilot oscillator in the prior device included an oscillator feedback transistor and a separate Darlington pair of latter operating as a gate. In the new device, the Darlington pair $Q_1$, $Q_2$ serves as both a feedback amplifier and as a gate. The main burner oscillator of the prior device included a feedback amplifier and a separate gate. In the new version $Q_3$, $Q_4$ serves as both the amplifier and the gate.

In order to sustain oscillation in the prior device, a positive feedback pulse from a transformer primary tap had to pass through a feedback capacitor to the base of the Darlington pair. If the base of one of a Darlington pair was then biased negatively, this positive pulse was passed and inverted and appeared as a negative pulse at the base of the feedback transistor. If the particulr Darlington transistor were not biased negatively, this positive pulse would not be passed and oscillation would not occur.

In the new device a positive pulse is taken from tap 47, passed through capacitor $C_2$ and applied to the base 99 of $Q_2$. If $Q_2$ is biased negatively, this pulse is passed by the $Q_1$, $Q_2$ Darlington pair and oscillation is allowed. If $Q_2$ is not biased negatively, then the positive pulse is not passed and oscillation cannot take place.

Phase reversal is accomplished by taking the feedback pulse from the secondary tap 47 of $T_1$ and applying it to a PNP oscillator instead of an NPN as in the prior device.

Because of the new device the transistors $Q_1$, $Q_2$, $Q_3$ and $Q_4$ are PNP, they are cut off when in lock-out and two old ballast lamps previously needed are now not required. And with the supply voltage now negative, a separate diode $D_5$ provides positive voltage for the timing circuit $R_2$, $R_3$, $R_4$, $R_5$, $C_3$, $C_4$, $D_2$ and $CR_1$ (sequencing interlock).

Another major change is in the manner the spark voltage is obtained. In the prior device the positive part of each oscillator wave form was taken from each primary, rectified and applied to a capacitor. This voltage was about 100 volts. Then the relaxation oscillator triggered an SCR allowing a capacitor to discharge through $T_3$ producing a spark.

In the new device, transformers $T_3$ and $D_6$ are used to provide 100 volts DC to charge capacitor $C_{11}$. The relaxation oscillator now consists of $L_1$, $C_{12}$, $R_{11}$ and $C_{11}$ and spark is produced as before through $CR_2$ and $T_4$.

Therefore, in the prior device the sparking could take place only when the pilot oscillator was running. The spark was suppressed when flame was present and the main burner was on. In the new device, the normally closed pilot relay contacts (84, 86) connect a shunt resistor $R_{12}$ across a capacitor $C_{12}$ to prevent sparking unless the pilot oscillator is running. But when a flame is sensed and the main burner turns on, the power to $T_3$ is interrupted by the opening of the normally closed contacts 87, 89 of the main burner relay $K_2$ and spark is suppressed.

Thus, the prior and new devices each partially performs in the same manner. Both sense a voltage flame rectified by flame rod 18 and apply it to different gates. The turned-on gate allows oscillations to take place, thus producing output power. The logic for generating and suppressing the spark is somewhat the same as before.

| CIRCUIT VALUES | | |
|---|---|---|
| Capacitor | $C_1$ | .33 μf |
| Capacitor | $C_2$ | .001 μf |
| Capacitor | $C_3$ | 3.3 μf |
| Capacitor | $C_4$ | 33 μf |
| Capacitor | $C_5$ | .33 μf |
| Capacitor | $C_7$ | .22 μf |
| Capacitor | $C_8$ | .01 μf |
| Capacitor | $C_9$ | 220 μf |
| Capacitor | $C_{10}$ | 10.0 μf |
| Capacitor | $C_{11}$ | 2.2 μf |
| Capacitor | $C_{12}$ | .01 μf |
| Capacitor | $C_{13}$ | .001 μf |
| Resistor | $R_1$ | 47 ohms |
| Resistor | $R_2$ | 2 megohms |
| Resistor | $R_3$ | 470K ohms |
| Resistor | $R_4$ | 3.3 megohms |
| Resistor | $R_5$ | 1.5K ohms |
| Resistor | $R_6$ | 47 ohms |
| Resistor | $R_7$ | 3.3 megohms |
| Resistor | $R_8$ | 2.0 megohms |
| Resistor | $R_9$ | 2.0 megohms |
| Resistor | $R_{10}$ | 220 ohms (½ watt) |
| Resistor | $R_{11}$ | 15 megohms |
| Resistor | $R_{12}$ | 2.7K ohms |
| Resistor | $R_{13}$ | 1.0K ohms |
| Resistor | R' | 5.1K ohms |
| Resistor | R" | 5.1K ohms |

What is claimed is:

1. Ignition apparatus responsive to a thermostat comprising: a main burner; a main valve actuable to admit gas to said main burner; a pilot burner; a pilot valve actuable to admit gas to said pilot burner; a spark generator comprised of an electrode adjacent said pilot burner actuable to emit a spark and thereby to ignite the pilot gas; a flame rod to detect pilot gas ignition; an A.C. voltage produced when heat is requested by said thermostat; a pilot oscillator; a main oscillator; first means connected to receive said A.C. voltage for causing said pilot oscillator to oscillate; second means for actuating said pilot valve when said pilot oscillator is oscillating, said second means including an electrically operable pilot burner switching control means comprised of a single-pole, double-throw switch having a pole connected to said A.C. voltage, a normally closed contact connected to said spark generator to inhibit the same, a normally open contact connected to said pilot valve, and a solenoid energized by said pilot oscillator while oscillating; third means for igniting said pilot gas via said electrode when said pilot oscillator is oscillating; fourth means connected from said flame rod for causing said main oscillator to oscillate; fifth means connected from said main oscillator to sustain said pilot oscillator oscillations; sixth means connected from said main oscillator to cause said main valve to open, whereby a flame of said pilot burner causes ignition of said main burner, said fifth means including an electrically operable main burner switching control means including a single-pole, double-throw switch having a pole connected to said A.C. voltage, a normally closed contact connected to the input of said spark generator to provide enabling power thereto, a normally open contact connected to said main valve, and a solenoid energized by said main oscillator while oscillating, whereby said pilot burner is ignited by said spark generator when heat is requested by said thermostat and said spark generator is inhibited while said main burner is ignited.

2. The invention as defined in claim 1, wherein said spark generator includes a silicon controlled rectifier (SCR) having an anode, a cathode and a gate, a serial connected resistor and capacitor having a mutual junction, a second resistor connected from said normally closed contact of said pilot burner switching control means to said mutual junction, a gas discharge lamp connected from said mutual junction to said SCR gate, said capacitor being connected to said SCR cathode, and a spark transformer having a primary winding connected from said first resistor to said SCR anode.

* * * * *